United States Patent [19]

Kelly

[11] 4,379,322

[45] Apr. 5, 1983

[54] COMPOUND REFLECTOR FOR LUMINAIRE

[75] Inventor: James P. Kelly, Waterford, Wis.

[73] Assignee: McGraw-Edison Company, Rolling Meadows, Ill.

[21] Appl. No.: 248,482

[22] Filed: Mar. 27, 1981

[51] Int. Cl.[3] ..... F21V 7/00

[52] U.S. Cl. ..... 362/300; 362/301; 362/302; 362/310; 362/311; 362/347; 362/349

[58] Field of Search ..... 362/297, 298, 300, 301, 362/302, 304, 310, 311, 346, 347, 349

[56] References Cited

U.S. PATENT DOCUMENTS

| | | | |
|---|---|---|---|
| 1,800,886 | 4/1931 | Dunlap . | |
| 1,835,745 | 12/1931 | Barbian . | |
| 2,913,570 | 11/1959 | Gough et al. . | |
| 3,679,893 | 7/1972 | Shemitz et al. . | |
| 3,944,810 | 3/1976 | Grindle | 362/297 |
| 4,150,422 | 4/1979 | Peralta et al. . | |
| 4,229,779 | 10/1980 | Bilson et al. . | |
| 4,293,901 | 10/1981 | Hernandez | 362/346 |
| 4,344,111 | 8/1982 | Ruud et al. | 362/297 X |

FOREIGN PATENT DOCUMENTS 471347 4/1969 Switzerland .

*Primary Examiner*—Peter A. Nelson

*Attorney, Agent, or Firm*—Charles W. MacKinnon; Ronald J. LaPorte; Jon C. Gealow

[57] ABSTRACT

An outdoor luminaire having a reflector adapted to provide uniform illumination of a relatively large, generally level surface. The reflector is comprised of a pair of side segments and contiguous concave top and bottom segments surrounding a light center. The top segment includes three cylindrical portions which are circular in section, the portion adjacent the top edge having its circular center well in front of the light center, while the other two circular cylindrical portions have their centers behind the light center. The bottom segment includes a transient portion and a cylindrical portion which is parabolic in section. The parabolic cylindrical portion is adjacent the bottom edge and has its foci at the light center. The side segments are tilted to reflect light from the light center directly out of the luminaire. The light pattern produced by the reflector is generally rectangular in shape with relatively sharp, straight, uniform light cut-off at both the front and sides with square corners at the forward edges.

10 Claims, 6 Drawing Figures

COMPOUND REFLECTOR FOR LUMINAIRE

BACKGROUND OF THE INVENTION

This invention relates to concave lamp reflectors within outdoor luminaires for use in providing uniform light distribution over a large, substantially planar area.

Outdoor luminaires having reflectors providing asymmetric light distribution and which attempt to produce an evenly lighted surface with relatively sharp top cut-offs are known in the art; see for example, U.S. Pat. Nos. 4,229,779 to Bilson and 3,679,893 to Shemitz et al. While the reflectors disclosed in the aforementioned patents provide acceptable planar light patterns for many applications, they suffer from certain drawbacks.

The Bilson reflector is configured to reflect a substantial portion of its upward direct light back in paths closely adjacent the light source. This is undesirable with the use of large enclosed high temperature lamps, such as, for example, Metal Halide, Mercury and High Pressure Sodium, because excessive heat build up in the vicinity of the light source has an effect of greatly shortening lamp life. The Shemitz et al. reflector is configured to produce from upwardly reflected light, a converging focal point in front of the light source. The converging light beams either diverge until striking the surface to be lit, thereby limiting the main beam concentration of the fixture and the size of the evenly lit area, or the diverging beams are reflected off a second large parabolic reflector awkwardly placed outside the closure of the luminaire to provide a main beam.

Neither the Shemitz et al. nor the Bilson luminaires allow for the repositioning of the light source with respect to the reflector to provide a variation in the light pattern. In addition, both the Shemitz et al. and the Bilson reflectors are configured with flat end portions which have their normal axis in line with the axis of the lamp. This produces a weak but wide lateral distribution area and allows excess light to fall behind the fixture. These conditions virtually prevent the provision of a rectangular light distribution pattern. This is important since absent a distinct rectangular light distribution pattern having a sharp, straight and uniform cut-off at both the front and sides with pronounced square corners at the forward edges, it is impractical to blend the light from more than one luminaire to produce uniform light over a relatively large flat surface.

SUMMARY OF THE INVENTION

Accordingly, it is a primary object of the present invention to provide in an outdoor luminaire an improved reflector configuration capable of producing uniform illumination of a relatively large, substantially level surface.

It is a further object of the invention to provide such a reflector in which light reflected back in the direction of the light source focuses, if at all, sufficiently far away from the light source to avoid heat build up which can reduce lamp life.

It is still a further object of the invention to provide a reflector of the above described type which produces a rectangular, light distribution pattern having sharp, straight, uniform light cut-off at both the front and sides with pronounced square corners at the forward edges.

It is still another object of the invention to provide in an outdoor luminaire, a reflector having a continuous, smooth, substantially concave surface which is relatively small in relation to lamp size and yet relatively large in relation to luminaire size thereby to provide an efficient luminaire package of minimal size.

DETAILED DESCRIPTION OF THE DRAWINGS

Figure 1:
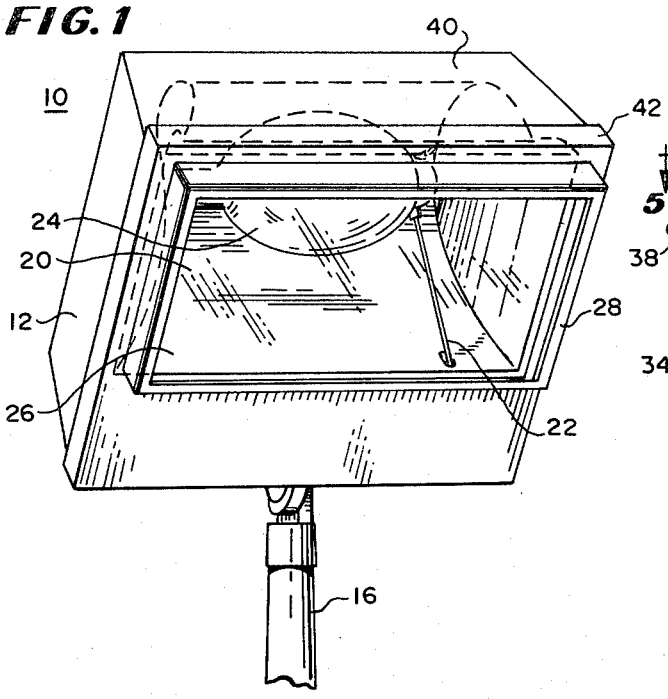
FIG. 1 is a perspective view of a luminaire, including a reflector according to the invention.

Referring now to the drawings and more particularly to FIG. 1, there is shown therein a luminaire 10 constructed in accordance with the present invention including housing 12 which is generally longitudinally and transversely rectangularly shaped and contains all the operating components required for lamp operation, such as, for example, a ballast (not shown). Housing 12 includes rear enclosure 40 and front face 42. Front face 42 includes a window or lens 26 mounted within a supporting structure 28. Mounted within the housing 12 is reflector 20 and lamp 24 according to the invention. Lens 26 covers the open end 27 of reflector 20.

Figure 4:
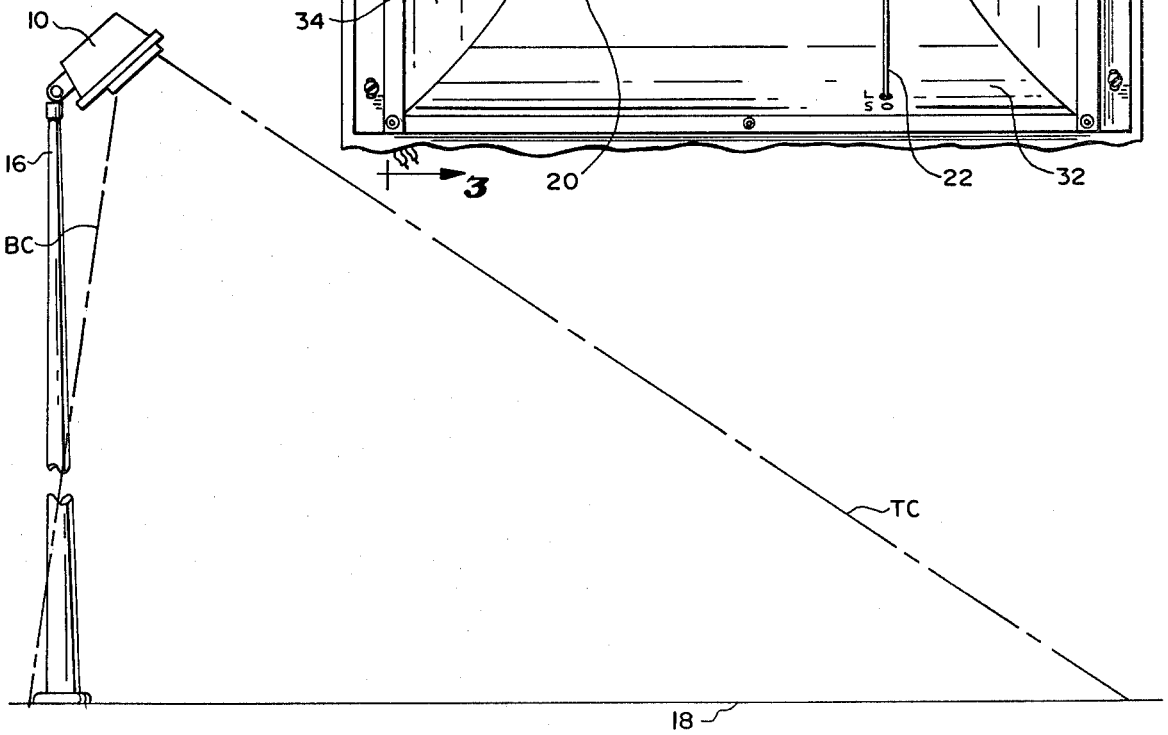
FIG. 4 is a diagrammatic elevational view of the luminaire of FIG. 1, pole mounted to illustrate the light distribution thereof over a level surface.
Figure 5:
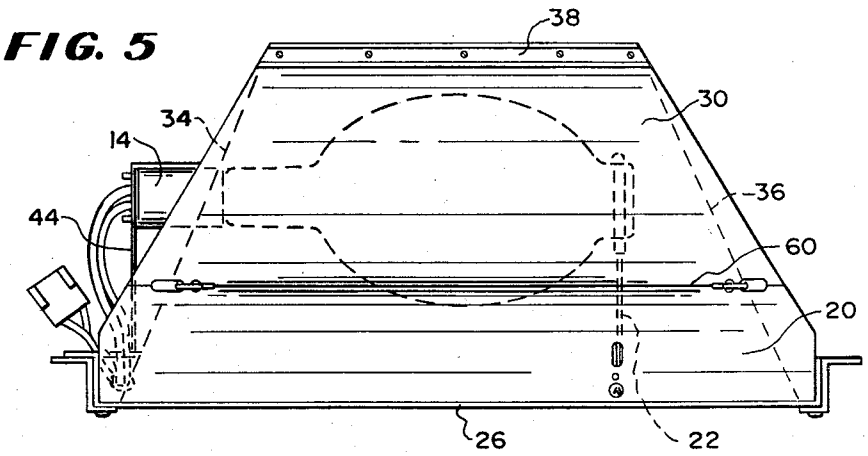
FIG. 5 is a top view of the reflector of FIG. 3 taken along line 5—5 thereof.

Luminaire 10 is mounted on pole 16 for illumination of a ground plane 18 from above (see FIG. 4). However, it should be understood that luminaire 10 may be ground mounted for illumination of the side of a building or structure or mounted directly to a structure for illumination of the structure side and ground areas adjacent the structure.

Figure 2:
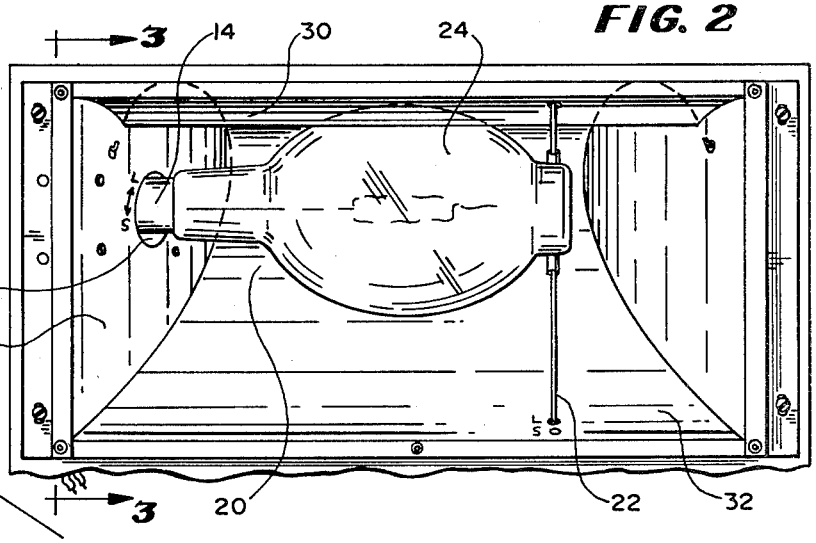
FIG. 2 is a partial front view of the luminaire of FIG. 1 shown with the front protective cover removed to expose the reflector.
Figure 6:
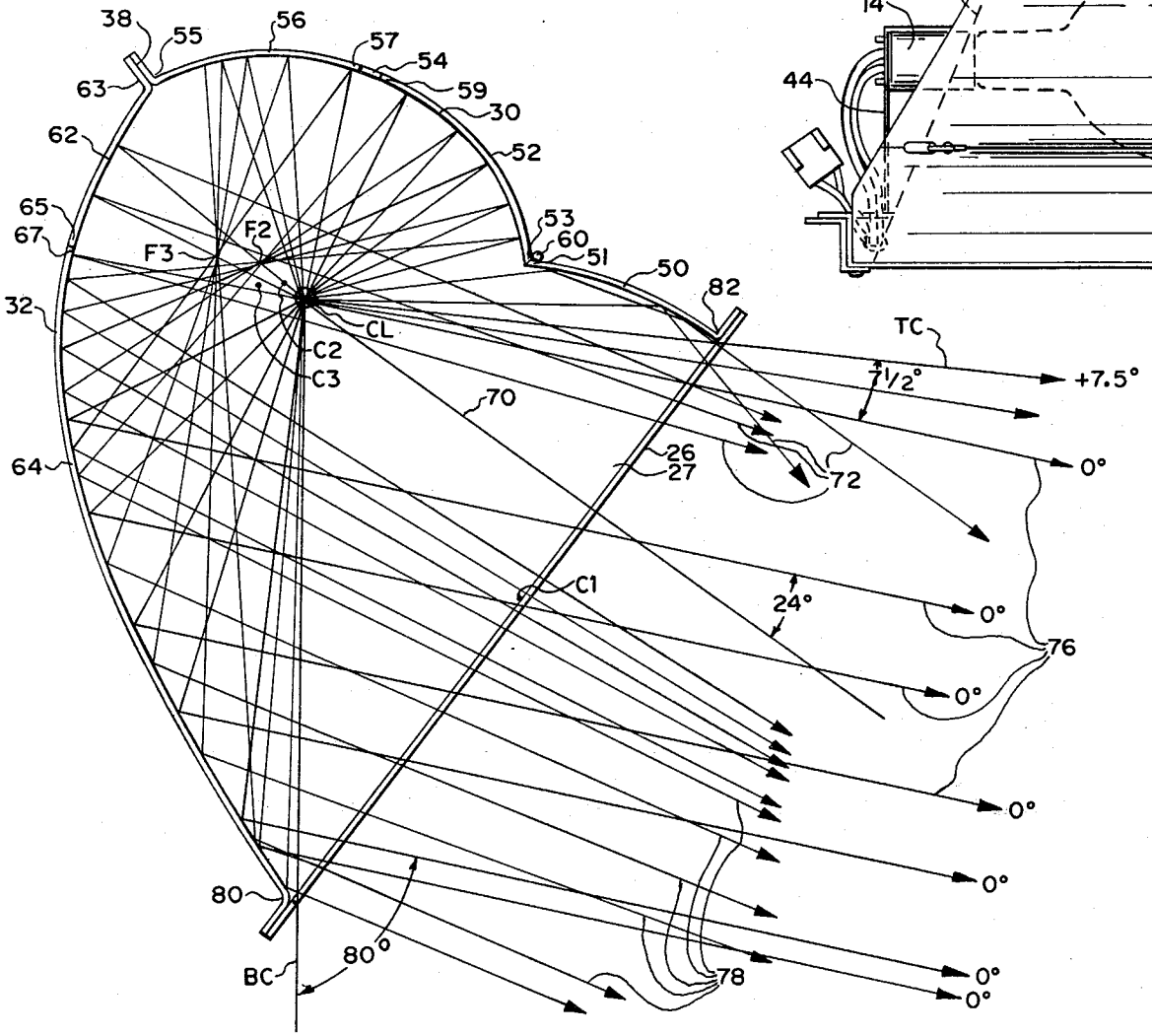
FIG. 6 is a diagramatic view of the reflector according to the invention illustrating the manner in which light derived from a light source of the luminaire is reflected to the area being illuminated thereby.

FIG. 2 is a frontal view of the complete reflector 20 with lamp 24 included. Lamp 24 is disposed parallel to the horizontal axis of the luminaire, relatively high within reflector 20. Centered within lamp 24 is an elongated light source having its center at the light center CL of reflector 20. Lamp 24 is supported at one end by socket 14 which extends through an opening 15 in a side segment 34 of reflector 20, and at its opposite end by a support wire 22. Socket 14 can be secured to a mounting bracket 44 through either of two sets of holes 46 or 48, respectively, for repositioning lamp 24 with respect to light center CL of reflector 20. When socket 14 is secured to bracket 44 through first set of holes 46, lamp 24 is situated in a long or optimum design position as shown in FIG. 6. When socket 14 is secured to bracket 44 through second set of holes 48, support wire 22 must be appropriately adjusted, i.e. shifted at its lower end from the L position to the S position (see FIG. 4), and lamp 24 is situated lower within the reflector 20, thereby producing a shorter, more dispersed light pattern with less sharp cut-offs and with a lower light angle than that shown in FIG. 4. Lamp 24 is preferably of the short to medium arc length type, such as, for example, Mercury, High Pressure Sodium or Metal Halide clear lamps. However, it is possible to use almost any light source including Tungsten, Halogen, or Fluoresent types. Lamp 24 is preferably sized, but not limited to, the 250 watt to 1500 watt power range.

Figure 3:
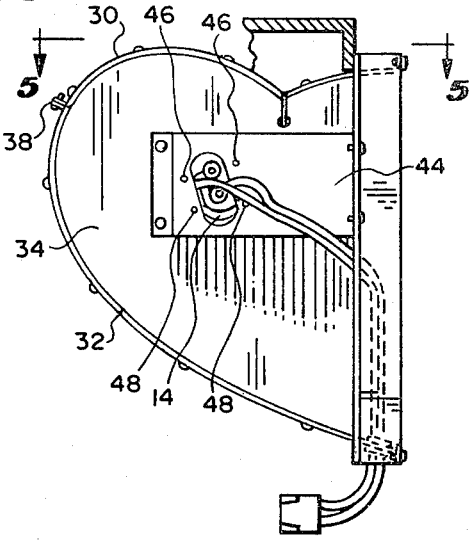
FIG. 3 is a side elevational view of the reflector of the luminaire of FIG. 2 taken along line 3—3 thereof.

Asymmetrically disposed about lamp 24 is reflector 20 according to the invention. Reflector 20 is constructed of four metallic segments, a top reflector segment 30, a bottom reflector segment 32, a first side reflector segment 34, and a second side reflector segment 36. The top reflector segment 30 and bottom reflector segment 32 are joined at junction 38 to form a generally continuous reflector surface at that point as shown in FIG. 3.

Top reflector segment 30 is preferably fabricated of a specular reflective material and bottom reflector segment 32 may be fabricated of either specular reflective material or semi-specular reflective material.

First side reflector segment 34 and second side reflector segment 36 are disposed within the luminaire housing 12 parallel to the vertical axis thereof and are contained within imaginary planes which intersect in a line behind reflector 20 parallel to the vertical axis of the luminaire. These imaginary planes are offset by an angle of at least 20 degrees from a plane extending normal to the horizontal axis of the luminaire which is parallel to the axis of light center CL. Reflector segments 34 and 36 are instrumental in producing a distinct rectangular light distribution pattern having sharp and straight cut-offs particularly at the sides and providing pronounced squared corners at the forward edges.

In FIG. 6, the configuration of reflector 20 is shown in section, the longitudinal extent of the top and bottom reflector portions shown being uniform. Accordingly, the following description of the top and bottom reflector segments and the shape and location of critical components will be defined for the most part in section. Top reflector segment 30 includes four reflector portions; a first cylindrical portion 50, circular in section, a second cylindrical portion 52, circular in section, a top transient portion 54 and a third cylindrical portion 56, circular in section.

Bottom reflector segment 32 includes two reflector portions, a bottom transient portion 62 and a cylindrical portion 64, parabolic in section.

First cylindrical portion 50 of top reflector segment 30 includes a first edge 82 defining the upper edge of open end 27 of reflector 20. The rear edge 51 of first cylindrical portion 50 is joined to front edge 53 of second cylindrical portion 52. A retaining wire 60 runs horizontally in a valley defined by the joined edges 51, 53 of the aforementioned cylindrical portions 50, 52, respectively, as seen in FIGS. 3 and 6. Rear edge 55 of third cylindrical portion 56 and rear edge 63 of bottom transient portion 62 of bottom reflector segment 32 are joined at junction 38. Top transient portion 54 is disposed between the front and rear edges 57 and 59, respectively, of third cylindrical portion 56 and second cylindrical portion 52, respectively. Front edge 65 of bottom transient portion 62 is joined to rear edge 67 of cylindrical portion 64, and front edge 80 of the cylindrical portion defines the bottom edge of open end 27 of the reflector.

In section, first cylindrical portion 50 has its circular center C1 at a point lying slightly above the horizontally bisecting center-line of open end 27. The second cylindrical portion 52 has its circular center C2 at a point behind light center CL on an imaginery line 70 which is perpendicular to the imaginary plane of open end 27 and runs through light center CL. The focal point F2 of light from light center CL which is reflected off second cylindrical portion 52 is still further behind light center CL on line 70 as seen in FIG. 6. In the preferred embodiment, first transient portion 54 is a relatively short, straight section which reflects light from light center CL down to the bottom reflector segment 32 and allows for a smooth transition between second cylindrical portion 52 and third cylindrical portion 56 without reflecting light back in the direction of the light center CL.

The third cylindrical portion 56 has its circular center point C3 behind and slightly below light center CL. The focal point F3 of light from light center CL which is reflected off third cylindrical portion 56 is positioned still further behind the circular center point C3 of third cylindrical portion 56, as seen in FIG. 6.

Second transient portion 62 has a shallow concave shape and reflects light from light center CL over the top of the light center and out of the luminaire through open end 27.

Reflector portion 64, which is parabolic in section has its foci at the light center CL and therefore projects all light received directly from the light center CL out through open end 27 at the same angle, as parallel rays 76 producing a main light beam. Main light rays are assumed to have a 0 degree departure angle as shown in FIG. 6. The main light beam rays 76 are in fact 24 degrees above the normal to the imaginary plane of open end 27. As can also be seen in FIG. 6, the light reflected from top reflector segment 30 converges in two places, F2 and F3, behind light center CL before falling on the bottom reflector segment 32. After these light beams are reflected off cylindrical portion 64 and out through open end 27 they appear as second and third light sources which produce a plurality of reinforcing light rays 78 slightly below the main light beam rays.

Additional mixing or blending beams 72 are added to the stronger narrow beams by first cylindrical portion 50 of top reflector segment 30 and bottom transient portion 62 of the bottom reflector segment 32 which as described is concave. Portion 62 in fact has a slight deviation in section from parabolic shape. Both of these reflector portions reflect light center light directly out through open end 27 without further reflection.

Light from lamp 24 emitted from light center CL is permitted to exit the reflector 20 at a maximum of 80 degrees below the main beam at which point it is cut-off by bottom opening edge 80 (see light ray BC, FIGS. 4 and 6). Light from lamp 24 emitted from light center CL is permitted to exit the reflector 20 at a maximum of only $7\frac{1}{2}$ degrees above the main beam at which point it is cut-off by top opening edge 82 (see light ray TC, FIGS. 4 and 6). Thus, when luminaire 10 is positioned as shown in FIG. 4, the main beam required to evenly illuminate the portion of surface 18 which is at the greatest distance from luminaire 10 and falls at the most acute angle of light incidence is provided at just $7\frac{1}{2}$ degrees below top cut-off. Reinforcing beams provided by light reflected off top reflector segment 30 and then bottom reflector segment 32 are intense enough to evenly illuminate intermediate sections of surface 18. Sections of surface 18 relatively close to luminaire 10, which require increasingly less concentrated light leaving luminaire 10 as the angle of incidence increases, are lit by light reflected from first cylindrical portion 50 of top reflector segment 30 and direct light from lamp 24.

The result is the capability of luminaire 10 of the present invention to produce uniform illumination of a relatively large, substantially level surface with a distinct rectangular light distribution pattern having sharp uniform light cut-off at both the front and sides and with substantially squared off corners at the two forward edges.

While only a single embodiment of the invention has been shown and described, it will be realized that various modifications thereof are possible without departing from the spirit and scope of the invention. It is accordingly intended that the scope of the invention as recited in the appended claims not be limited to such specific embodiment described.

I claim:

1. A luminaire adapted to illuminate a generally planar surface with substantially constant light magnitude with a light pattern having relatively sharp bottom and top cut-offs comprising:

a light source, a concave reflector having an open end, a closed end and a light center defined therein, said light source mounted within said concave reflector, said open end having a top edge and a bottom edge, said concave reflector including a top reflector segment and a bottom reflector segment, said top reflector segment having a first cylindrical portion circular in section, a second cylindrical portion circular in section, and a third cylindrical portion circular in section, said first cylindrical portion being situated between said top edge of said concave reflector and said second cylindrical portion and having its circular center forward of the light center in the direction of said open end of said concave reflector, said second cylindrical portion being situated between said first cylindrical portion and said third cylindrical portion and having its circular center behind said light center in the direction of said closed end, said third cylindrical portion being situated between said second cylindrical portion and said bottom reflector segment and having its circular center behind said light center in the direction of said closed end, said bottom reflector segment having a bottom transient portion and a cylindrical portion parabolic in section, said bottom transient portion being situated between said top reflector segment and said parabolic cylindrical portion, said parabolic cylindrical portion being situated between said bottom transient portion and said bottom edge of said concave reflector, and having its foci at the light center.

2. The luminaire as claimed in claim 1 wherein said light source is located at said light center.

3. The luminaire as claimed in claim 1 wherein said top reflector segment further includes a top transient portion, said top transient portion being situated between said second and third cylindrical portions.

4. A luminaire as claimed in claim 3 wherein said top transient portion is substantially flat and shorter in length than said cylindrical portions.

5. The luminaire as claimed in claim 1 having vertical and horizontal axis and wherein said concave reflector further includes a first planar side segment and a second planar side segment, said first and second planar side segments being contained within imaginary planes which intersect in a line parallel to said vertical axis behind said concave reflector, said imaginary planes being offset by an angle of at least 20 degrees from a plane extending normal to the horizontal axis of said luminaire and wherein said light center is parallel to said horizontal axis of said luminaire, said planar side segments producing relatively sharp side cut-offs in said light pattern.

6. The luminaire as claimed in claim 5 wherein said concave reflector is enclosed within a protective housing said protective housing having a substantially transparent lens covering said open end of said concave reflector, said housing also containing a ballast for operation of said lamp.

7. The luminaire as claimed in claim 2 further including means for repositioning said light source away from and to a position below said light center and closer to the opening of said concave reflector for providing a shorter, more dispersed light pattern with less sharp bottom and top cut-offs.

8. The luminaire as claimed in claim 1 wherein said top reflector segment has a specular reflective surface.

9. The luminaire as claimed in claim 8 wherein said bottom reflector segment has a semi-specular reflective surface.

10. The luminaire as claimed in claim 8 wherein said bottom reflector segment has a specular reflective surface.

* * * * *